United States Patent [19]

Munten

[11] 4,395,189

[45] Jul. 26, 1983

[54] DUAL MAST LIFT TRUCK FOR UNBALANCED LOADS AND THE LIKE

[76] Inventor: Gerard H. Munten, 4089 Remembrance Rd., Grand Rapids, Mich. 49504

[21] Appl. No.: 230,611

[22] Filed: Feb. 2, 1981

[51] Int. Cl.[3] ..... B66F 9/03; B66F 9/22

[52] U.S. Cl. ..... 414/635; 414/638; 414/642; 187/9 E

[58] Field of Search ..... 414/635, 636, 634, 632, 414/631, 630, 629, 628, 642, 638, 637, 664, 663, 668, 633, 641, 640, 639, 665, 666, 667, 471; 187/9 R, 9 E

[56] References Cited

U.S. PATENT DOCUMENTS

| | | | |
|---|---|---|---|
| 2,362,129 | 11/1944 | Gfrorer . | |
| 2,456,320 | 12/1948 | Repke . | |
| 2,477,789 | 8/1949 | Dunham . | |
| 2,668,602 | 2/1954 | Cushman . | |
| 2,682,349 | 6/1954 | Jackson . | |
| 2,929,524 | 3/1960 | Carlson et al. | 414/632 |
| 2,996,206 | 8/1961 | McKee | 414/631 |
| 3,039,637 | 6/1962 | Akrep . | |
| 3,075,665 | 1/1963 | Repke . | |
| 3,119,506 | 1/1964 | Bridge et al. | 414/631 |
| 3,494,494 | 2/1970 | Lindgren . | |
| 3,997,029 | 12/1976 | Evans . | |
| 4,096,961 | 6/1978 | Rocco | 414/642 |
| 4,326,830 | 4/1982 | Cusack | 414/471 X |

*Primary Examiner*—Bruce H. Stoner, Jr.

*Attorney, Agent, or Firm*—Price, Heneveld, Huizenga & Cooper

[57] ABSTRACT

A conventional lift truck is provided with a dual mast arrangement for handling heavy, unbalanced loads, and other awkward objects. Two masts are individually connected with the truck frame in a side-by-side relationship, and each mast includes a fork which is movable up and down its respective mast. The masts are powered by separate motors, and a controller operates the two motors. The controller is capable of independently moving each fork to individually elevate the forks into abutment with the load, and then raise the load slightly into a position in which the load is balanced on the forks. The controller includes a coupler which translates the forks in unison at substantially the same rate and in the same direction, such that the forks are raised simultaneously to lift the load balanced thereon to a transport position, and are lowered together to set the load down in place.

18 Claims, 6 Drawing Figures

DUAL MAST LIFT TRUCK FOR UNBALANCED LOADS AND THE LIKE

BACKGROUND OF THE INVENTION

The present invention relates to lift trucks, and in particular to a dual mast lift truck designed for lifting heavy unbalanced and awkward loads.

The conventional lift arrangement for fork lift trucks comprises a pair of tines which are mounted on a single mast or column. Both tines move together up and down the mast, and are designed to lift palletized loads, transport bins, racks, and other standardized containers and objects.

The movement of large, heavy industrial machines, such as presses, brakes, packaging equipment, etc., in factories and plants is a very time consuming, tedious, hazardous and difficult task. Such equipment is typically quite heavy and awkward, and does not have balanced weight distribution or handy grip holds from which the machinery can be lifted.

Heretofore, trucks with standard lift arrangements, as discussed hereinabove, have been used to move heavy industrial equipment. Most factories do not have permanent overhead cranes or other similar lift devices to move equipment. To pick up machinery with a conventional, single mast lift arrangement, blocks must be attached to the forks so that they will mate with those surfaces from which the machine is to be lifted. The blocked lift forks are then positioned underneath the machine, and raised until the blocked forks abut the machine. It is extremely difficult to accurately adjust the blocks on the forks so that they will abut the machine squarely and evenly. The machine must then be chained or strapped to the lift forks to insure that the machine will not fall off the forks during transport. When the machinery to be moved is raised to the transport position, unless the forks are positioned directly below the machine's center of gravity, the machine will tend to tip or slide off of the lift forks. As a result, the chains or strapping must be very securely attached to the machine and lift tines. The stress applied to the machine by the chains can cause damage to the machine, particularly if the load shifts slightly. The machine must often be set down, and the blocks and forks repositioned to achieve proper balance. The difficulties associated with properly balancing heavy machinery on the tines of standard, single mast lift trucks creates an inherently dangerous situation, which is quite hazardous to the safety of the workman.

SUMMARY OF THE INVENTION

One aspect of the present invention is to provide a conventional lift truck with a novel dual mast arrangement for safely and easily handling heavy, unbalanced loads, and other awkward objects. Each mast includes a lift fork which can be independently operated to engage the object to be lifted at convenient locations on either side of the object's center of gravity. The tines are individually raised slightly to balance the load on the tines, and the operation of the two tines is then coupled together so that they move together at substantially the same rate and in the same direction so as to lift the object into a transport position. Preferably, the masts are pivotally attached to the truck frame, and include pivot means to independently tilt the mast, and a controller to couple the tilting function so that the two masts tilt in unison. The dual mast lift arrangement is capable of safely moving unbalanced and awkward objects without requiring that the objects be strapped or chained to the lift forks. Hence, the device is quite easy to use, and is capable of safely moving very heavy equipment without damaging the same.

These and other features, advantages and objects of the present invention will be further understood and appreciated by reference to the following written specification, claims and appended drawings.

DETAILED DESCRIPTION OF THE PREFERRED EMBODIMENT

Figure 1:
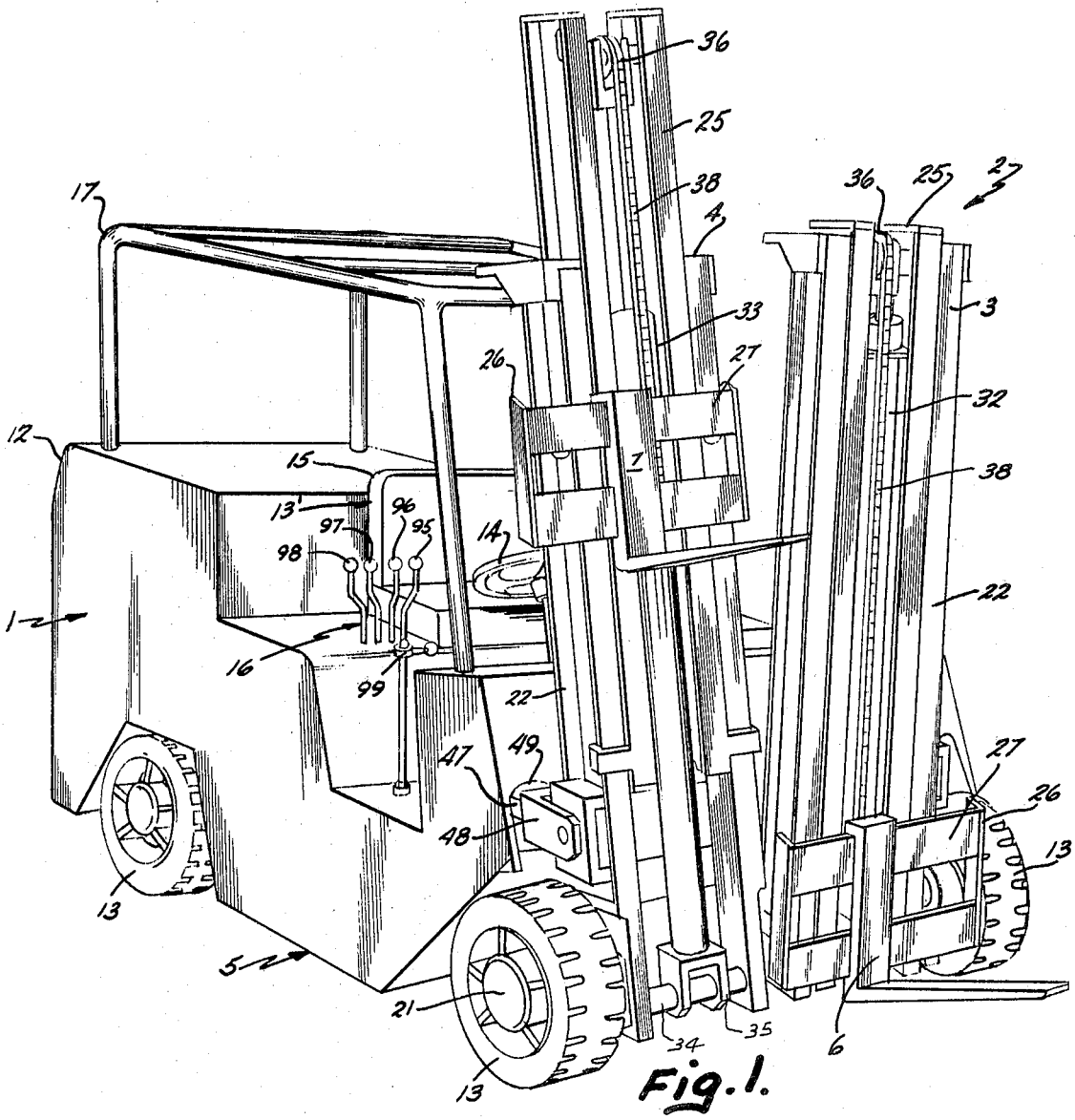
FIG. 1 is a perspective view of a dual mast lift truck embodying the present invention.

For purposes of description herein, the terms "upper," "lower," "right," "left," "rear," "front," "vertical," "horizontal," and derivatives thereof shall relate to the invention as oriented in FIG. 1, with respect to a seated operator. However, it is to be understood that the invention may assume various alternative orientations, except where expressly specified to the contrary.

Reference numeral 1 (FIG. 1) generally designates a conventional lift truck 1, having a special dual mast lift arrangement 2 embodying the present invention. Two masts 3 and 4 are individually connected with the frame 5 of truck 1 in a side-by-side relationship, and each mast includes a fork 6 and 7 which is movable up and down its respective mast 3 and 4.

Aside from the dual mast arrangement 2, and other features noted hereinafter, lift truck 1 is of a generally conventional construction, and includes a chassis 12 (FIG. 1) supported on four ground engaging wheels 13. Lift truck 1 is self-propelled by means such as an internal combustion engine (not shown) or the like. The chassis 12 comprises an operator control area 13' from which the lift truck is manipulated, and includes a steering wheel 14, a seat 15, and a plurality of hydraulic valve control levers 16 disclosed adjacent seat 15, which are described in greater detail hereinafter. The illustrated lift truck includes a roll cage 17 to provide additional safety.

Figure 2:
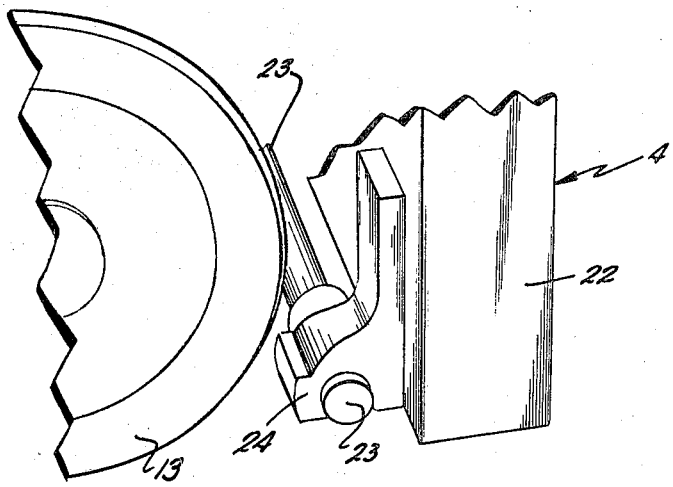
FIG. 2 is a fragmentary, perspective view of a forward end portion of a slightly different embodiment of the lift truck, particularly showing the pivotal attachment of the masts to the vehicle frame.

Each of the masts 3 and 4 has a construction which is somewhat similar to a conventional, single mast arrangement. As best illustrated in FIG. 2, the masts 3 and 4 include a vertical frame 22 which is pivotally attached at its base to the front end of lift truck 1 by an axle and bracket 23 and 24 respectively. Masts 3 and 4 are arranged in a side-by-side relationship on axle 23. Preferably, axle 23 is located as close as possible to the axis of rotation of the front vehicle wheels 13. In the example illustrated in FIG. 1, masts 3 and 4 are positioned wholly between the front vehicle wheels 13, and pivot about an axis substantially coincident with axle 21. In the example illustrated in FIGS. 2–4 and 6, axle 23 is disposed slightly forward of the front wheels 13 of truck 1.

Each frame 22 (FIG. 1) has a generally channel-shaped transverse cross section in which a slide assembly 25 is telescopingly received. Carriages 26 are slidingly mounted on the frames 22 and support forks 6 and 7 thereon. Preferably, carriages 26 include a pair of spaced apart, generally horizontally extending bars 27 on which forks 6 and 7 are slideably mounted, so that the forks can be moved laterally to adjust them to a particular position for lifting. Forks 6 and 7 extend forwardly from carriages 26 in a generally parallel relationship with respect to each other and the longitudinal axis of the lift truck 1.

A pair of hydraulic cylinders 32 and 33 are connected with the dual mast lift arrangement to translate the forks 6 and 7 and respective carriages 26 on mast frames 22. The lower, housing end of the cylinders 32 and 33 are pivotally attached to axles 34 on mast frames 22 by clevis brackets 35. In the embodiment illustrated in FIGS. 3–4, the upper ends of the cylinder rods 31 include a dual sprocket assembly 36 which is attached to slide 25 by a header 37. Two strands of roller chain 38 have their rearward ends rigidly anchored to mast frames 22 on cross braces 39. The roller chain strands 38 extend upwardly from braces 39, are entrained over the associated sprockets on assembly 36, and extend downwardly with their forward ends attached to the fork carriages 26. When the cylinders 32 and 33 are extended, slides 25 are lifted and extend longitudinally out of mast frame 22. The roller chains 38 simultaneously lift the fork carriages 26 slidingly along mast frames 22, thereby raising the forks 6 and 7 to a selected elevation.

Figure 3:
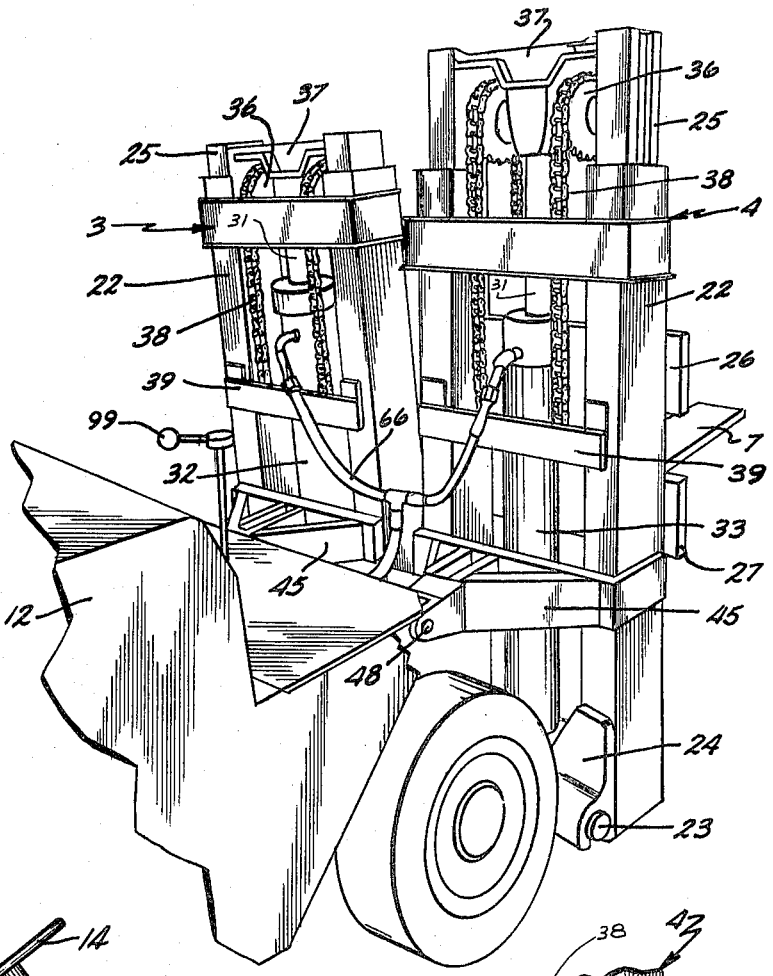
FIG. 3 is a fragmentary, perspective view of the lift truck illustrated in FIG. 2, particularly showing the rearward side of the masts.
Figure 4:
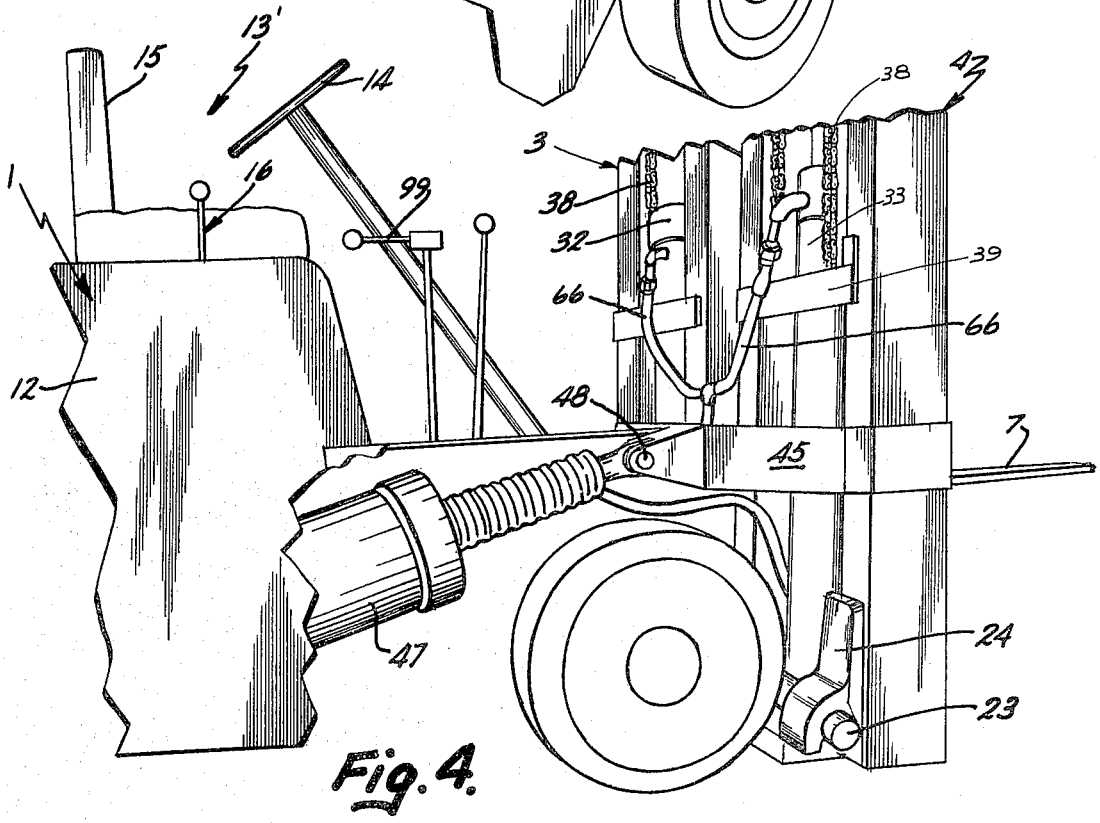
FIG. 4 is a fragmentary, side perspective view of the lift truck shown in FIG. 2.

With reference to FIGS. 3 and 4, the lower ends of mast frames 22 are pivotally attached to the vehicle by axle 23 and bracket 24. Two generally Y-shaped brackets 45 are fixedly attached to mast frames 22 at a location spaced above axle 23. A pair of double acting cylinders 46 and 47 have their rearward ends pivotally attached to the vehicle frame, and their forward ends pivotally connected with brackets 45 at clevis joints 48. Extension and retraction of cylinders 46 and 47 bodily pivots the respective frame 22 about axle 23.

The lift and mast pivot arrangement for the embodiment illustrated in FIG. 1 is substantially identical to the embodiment shown in FIGS. 3–4 described above, except that the sprocket assemblies 36 have a single gear and only one drive chain 38. Further, because the mast frames 22 are located between the front vehicle wheels 13, the rod portion of tilt cylinders 46 and 47 extends through a mating aperture 49 through the front wall of chassis 12.

Figure 5:
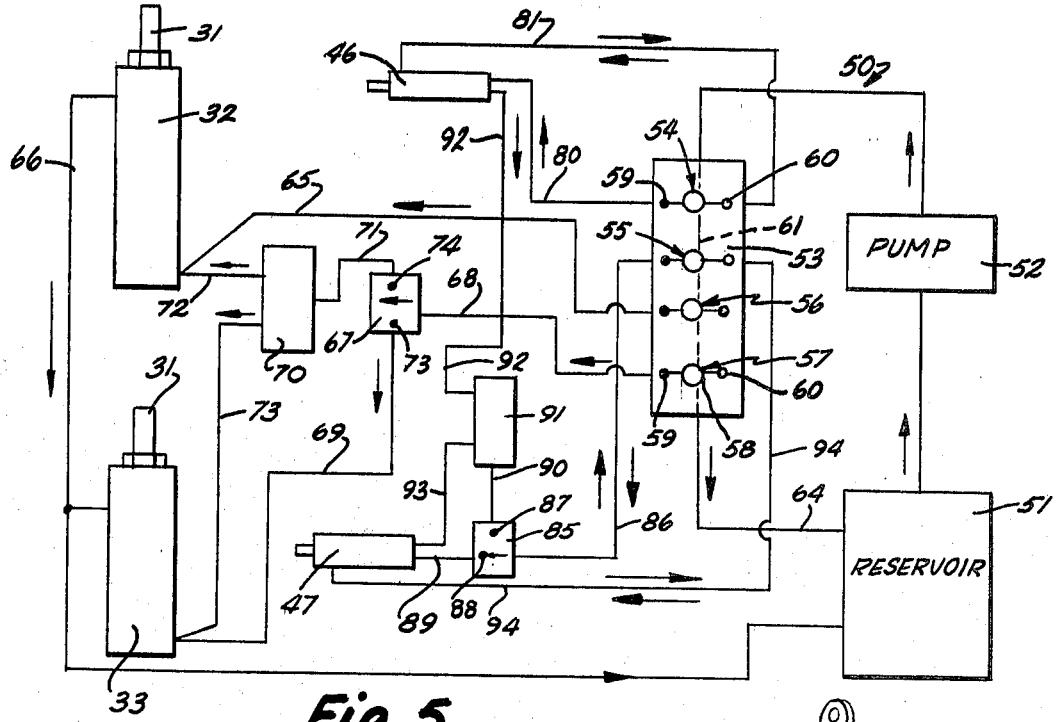
FIG. 5 is a schematic illustration of a pressurized hydraulic system for operating the masts and forks.

As best illustrated in FIG. 5, a pressurized hydraulic system is provided to control the operation of lift cylinders 32 and 33, and tilt cylinders 46 and 47. The hydraulic fluid system is generally designated by the reference numeral 50, and includes a reservoir 51 and a pump 52 which flows hydraulic fluid under pressure from the reservoir into a valve block 53. Valve block 53 includes a lever operated valve for each hydraulic cylinder in the lift and tilt arrangement. In this example, valve block 53 includes four double acting valves 54–57, each of which has a central closed position 58 and two open positions 59 and 60 which control the direction of fluid flow from the respective valve. In each valve 54–57, when the valve is open to one of the two open positions 59 and 60 to permit pressurized fluid to flow therethrough, the other side of the valve is simultaneously open to permit low pressure fluid to exhaust into a bypass or return line 61, as described in greater detail hereinafter. Central bypass line 61 extends through valve block 53, and communicates with reservoir 51 through line 64.

Valve 56 and 57 control the operation of the fork lift cylinders 32 and 33 respectively. Side 59 of valve 56 communicates directly with the power or extend end of cylinder 32 through line 65. The opposite or retract end of cylinder 32 communicates with reservoir 51 through a return header or exhaust manifold 66. In this example, lift cylinders 32 and 33 are single acting, such that when valves 56 or 57 are moved to position 60, the weight of the slide 25 and carriage 26, as well as any weight on forks 6 and 7 themselves, exhausts hydraulic fluid from the extend or power end of the cylinders 32 and 33 into central bypass line 61 in valve block 53, thereby lowering the forks. However, it is to be understood that cylinders 32 and 33 may be double acting, so that the lowering of the forks 6 and 7 is positively powered.

Side 59 of valve 57 is communicated with a two-way valve 67 by line 68. Side 73 of two-way valve 67 communicates with the power end of lift cylinder 33 through line 69. The other side 74 of two-way valve 67 communicates with a divider valve 70 through line 71. Divider valve 70 divides the flow of hydraulic fluid therethrough into two equal streams of equal pressure and flow, and directs the same respectively to the power side of cylinder 32 through line 72, and to the power side of cylinder 33 through line 73.

In operation, to independently manipulate lift cylinders 32 and 33, flow control valve 67 is rotated to open side 73, thereby simultaneously closing side 74. By opening side 59 of valve 56, pressurized hydraulic fluid is applied to the extend side of cylinder 32 through line 65, thereby extending the associated cylinder rod 31. Hydraulic fluid trapped on the opposite side of the piston is exhausted into reservoir 51 through return header 66. When valve 56 is shifted to position 60, the hydraulic fluid on the power side of cylinder 32 is released into bypass line 61 as described above, causing fork 6 to descend. In the central, closed position 58 of valve 56, the cylinder rod 31 and fork 6 remain fixed or stationary.

In like manner, by opening side 59 of valve 57, pressurized hydraulic fluid flows through line 68 and valve 67, and into line 69 to the power side of cylinder 33, thereby causing the cylinder rod to extend. Fluid trapped on the opposite side of cylinder 33 is likewise exhausted into reservoir 51 through header 66. Fork 7 is lowered by shifting valve 57 to position 60, as described above. Hence, when valve 67 is in position 73, lift cylinders 32 and 33 operate totally independently for individually positioning the two forks 6 and 7.

By turning control valve 67 to position 74, cylinders 32 and 33 will extend and retract in unison. Once the truck operator has individually positioned both forks 6 and 7 to their desired position, he rotates valve 67 from position 73 to position 74, and then manipulates only valve 57 to raise both tines at substantially the same rate and in the same direction. By opening side 59 of valve 57, pressurized fluid flows through line 68 and valve 67, into divider 70 through line 71. The equal streams of fluid exiting from divider 70 through lines 72 and 73 raise the cylinders 32 and 33 in unison. When valve 57 is shifted to position 60, the flow of hydraulic fluid exhausted from the extend side of cylinders 32 and 33 is controlled by divider 70, so that forks 6 and 7 descend in unison.

The operation of the tilt cylinders 46 and 47 is quite similar to the operation of the lift cylinders 32 and 33. However, in this example, tilt cylinders 46 and 47 are double acting, so that the masts 3 and 4 can be powered to pivot in both rotational directions. Valve 54 controls the operation of cylinder 46, and has its outlet side 59 connected with the extend side of cylinder 46 through line 80. A return line 81 communicates the opposite side of tilt cylinder 46 with the other side 60 of valve 54, such that when valve 54 is moved to position 59, hydraulic fluid enters the extend side of cylinder 46 and extends the same. The fluid trapped on the retract side of the hydraulic cylinder 46 is exhausted into bypass line 61 in valve block 53 through line 81. When valve 54 is moved to position 60, hydraulic fluid flows in the opposite direction to the retract side of tilt cylinder 46 to retract the cylinder, and the fluid on the extend side of the cylinder piston exhausts into valve block bypass 61 through line 80.

Valve 55 controls the operation of tilt cylinder 47, and the outlet side 59 of valve 55 communicates with a two-way valve 85 through line 86. Valve 85 has two positions 87 and 88 respectively which divert the flow of fluid into lines 89 and 90. Line 89 communicates with the extend side of cylinder 47, and line 90 communicates with a divider 91 which is similar in operation to divider 70, and includes two output lines 92 and 93 through which equal streams of hydraulic fluid are flowed to cylinders 46 and 47.

In operation, when valve 85 is in position 88, pivot cylinders 46 and 47 operate completely independently. Manipulation of valve 54 extends and retracts cylinder 46, and manipulation of valve 55 extends and retracts cylinder 47. To couple pivot cylinders 46 and 47, the operator rotates valves 85 from position 88 to position 87, and manipulates only valve 55. When valve 55 is moved to the open position 59, pressurized hydraulic fluid is forced through line 86, through valve 85, and into divider 91. Equal streams of hydraulic fluid exit from divider 91 into lines 92 and 93, thereby extending cylinders 46 at substantially the same rate and in the same direction. Hydraulic fluid trapped on the retract sides of tilt cylinders 46 and 47 is exhausted into the bypass circuit 61 of valve block 53 through lines 81 and 94. A similar divider valve arrangement (not shown) can be provided on line 94 of valve 55 so that cylinders 46 and 47 can also be retracted in unison.

Each of the hydraulic valves 54–57 includes a control arm or lever 95–98 (FIGS. 1 and 6) respectively for shifting the valves between valve positions 59–60. Valves 55–57 are normally biased to the closed position 58. Control levers 95–98 are preferably located in the operator control area of lift truck 1, adjacent the driver's seat 15 so that they can be manipulated by one hand of a seated truck operator. In the illustrated example, levers 95–98 are positioned on the right-hand side of the driver's seat 15, and are pivotally mounted just below the seat support of the lift vehicle. Control valve 67 has a rotating control lever 99 mounted in the floor of the lift vehicle adjacent the right-hand side of seat 15 and forward of valve arms 95–98.

Figure 6:
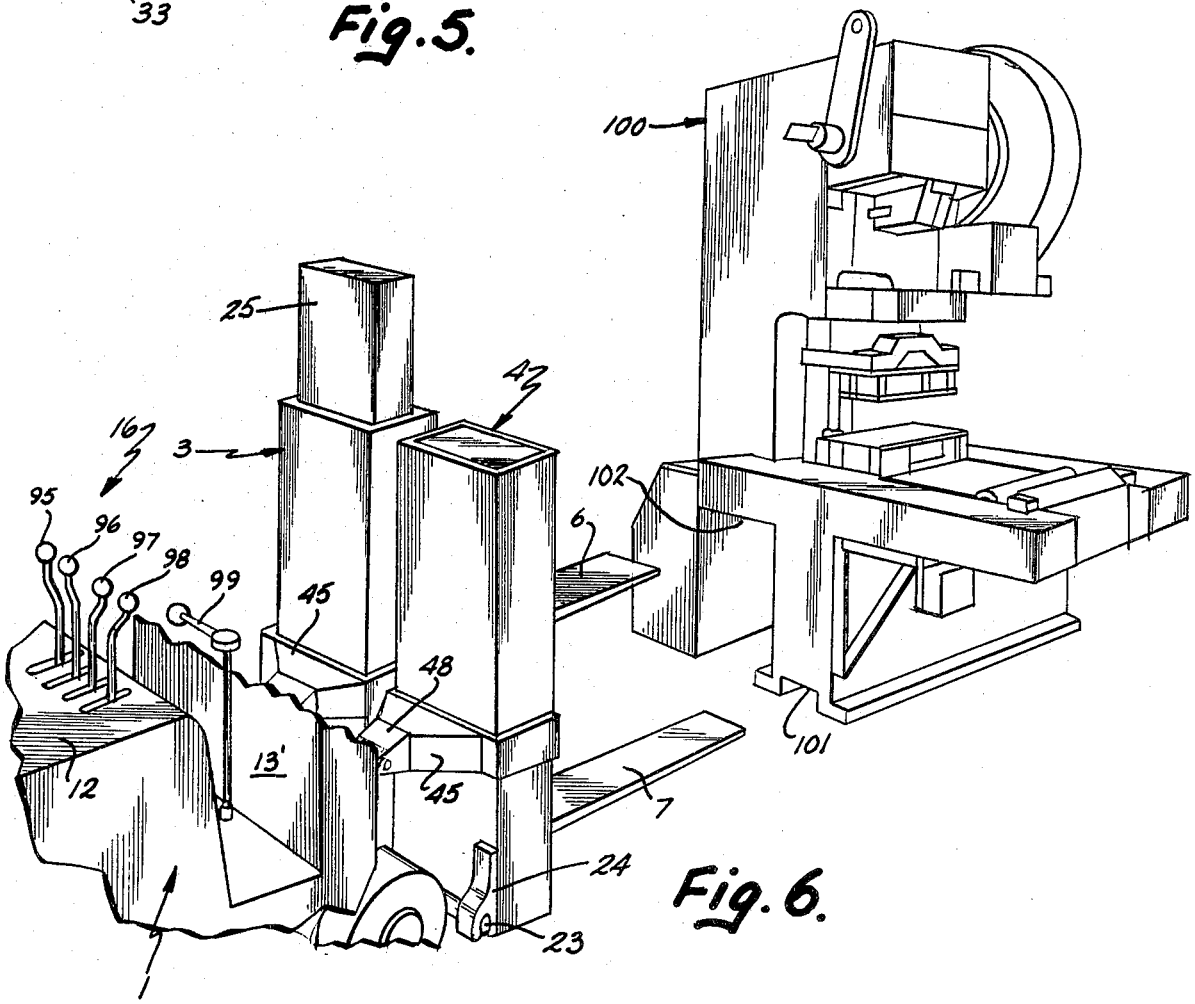
FIG. 6 is a partially schematic perspective view of the lift truck of FIG. 2, shown in a position for moving a punch press.

To move heavy equipment, lift truck 1 is positioned adjacent the machinery to be moved, such as the punch press 100 shown in FIG. 6. The forks 6 and 7 are longitudinally aligned with the grip holds or other surfaces from which the machine is to be lifted. In this example, punch press 100 has an opening 101 in a foot member at the forward portion of the press, and a higher opening or ledge 102 adjacent the rear portion of the press. The operator first moves forks 6 and 7 laterally on their respective carriages 26 so that they span the press and will slide into their respective openings 101 and 102. Next, forks 6 and 7 are individually raised or lowered to an elevation which will permit the operator to telescopingly insert the fork into the respective opening. This is accomplished by shifting flow control valve 67 to position 73. The control lever for valve 56 is then pivoted either forwardly or rearwardly to move fork 6 to an elevation commensurate with the top surface of opening 102. In like manner, the control lever for valve 57 is moved forwardly or rearwardly to elevate fork 7 so it is spaced slightly below the surface of opening 101. Usually, both masts 3 and 4 are pivoted slightly downwardly during insertion of forks 6 and 7 into the machine openings. However, they may be pivoted to virtually any orientation which will mate with the opening to be entered.

The lift truck is then propelled forwardly until forks 6 and 7 are disposed nearly wholly inside grip openings 101 and 102. Forks 6 and 7 are then lifted individually by operation of valves 56 and 57 into abutment with the lift surfaces of machine openings 101 and 102, so that the machine is balanced on the forks. If the operator finds that the machine's center of gravity is not positioned exactly between the location at which he has forks 6 and 7 inserted, he can tilt the machine slightly by manipulating either valve 56 or 57, and thereby moving the associated fork to shift the machine's center of gravity to a more balanced condition between the forks. The operator can manipulate pivot valves 54 and 55 either independently or in unison to tilt the machine 100 back slightly toward masts 3 and 4 to insure that it will not fall forward off of the forks. The operator then moves valve 67 to position 74, and shifts the control lever for valve 57 so that both of the forks 6 and 7 are elevated substantially simultaneously at the same rate to a raised, transport position.

Machine 100 is then transported on the truck vehicle 1 to the desired location. The operator, with valve 67 in the coupled position 74, manipulates the lever arm for valve 57, so that lift cylinders 32 and 33 descend in unison. In a similar manner, tilt cylinders 46 and 47 are pivoted in unison with valve 85 in coupled position 87 to gently seat the machine down squarely in its new location. Forks 6 and 7 are then lowered slightly either individually or in unison, so that they can be withdrawn from the grip openings 101 and 102 in the machine.

The dual mast lift truck 1 of the present invention provides a mechanism capable of quickly and safely lifting heavy, unbalanced and awkward industrial equipment without damaging the same. The ability to control both the mast pivot and fork movement independently, and in unison, provides a quite safe, efficient operation.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. In a conventional lift truck having a frame with front and rear ends, and means for propelling said truck, the improvement of a dual mast arrangement for handling unbalanced loads and the like, comprising:

first and second lift masts connected with the front end of said truck frame in a side-by-side relationship; each lift mast having a fork slideably connected therewith for translating up and down its respective mast; said forks extending generally outwardly from said masts in a generally parallel relationship;

means for independently moving said forks along their respective masts, whereby each fork is individually elevated into abutment with a load, and raised slightly to a position wherein the load is balanced on said forks; and coupling means for selectively interlocking said forks and moving the same in unison, substantially simultaneously at the same rate and in the same direction, by manipulation of a single control, whereby said forks are raised together to lift the load balanced thereon to a transport position, and are lowered together to set the load down in place.

2. A lift truck as set forth in claim 1, including:

means for pivotally connecting said masts with said truck frame;

means for independently pivoting said masts; and means for pivoting said masts substantially simultaneously at the same rate and in the same direction.

3. A lift truck as set forth in claim 2, wherein:

said mast pivoting means comprises first and second double acting hydraulic cylinders.

4. A lift truck as set forth in claim 3, wherein:

said independent mast pivoting means comprises a pressurized hydraulic fluid system having a valve block with a valve therein for each hydraulic cylinder, and means for communicating each valve with its associated cylinder, whereby selective manipulation of said valves extends and retracts said cylinders to individually tilt said masts.

5. A lift truck as set forth in claim 4, wherein said simultaneous pivot means comprises:

a two-way valve disposed in a hydraulic line communicating one of said hydraulic cylinders with said pressurized hydraulic fluid system; said two-way valve having a first position wherein the hydraulic fluid is communicated directly with said one hydraulic cylinder, and a second position wherein the hydraulic fluid is communicated with a divider line;

a flow control valve positioned in said divider line downstream of said two-way valve, and including means for dividing the flow of hydraulic fluid therethrough into two equal streams; and means for communicating each of said two equal hydraulic streams from said flow control valve with a different one of said hydraulic cylinders, whereby when said two-way valve is in said second position, said masts are pivoted simultaneously at substantially the same rate and in the same direction.

6. A lift truck as set forth in claim 1, wherein:

said independent fork moving means comprises first and second hydraulic cylinders.

7. A lift truck as set forth in claim 6, wherein:

said independent fork moving means further comprises a pressurized hydraulic fluid system having a valve block with a valve therein for each hydraulic cylinder, and means for communicating each valve with its associated cylinder, whereby selective manipulation of said valves extends and retracts said cylinders to individually raise and lower said forks.

8. A lift truck as set forth in claim 7, wherein said fork coupling means comprises:

a two-way valve disposed in a hydraulic line communicating one of said hydraulic cylinders with said pressurized hydraulic fluid system; said two-way valve having a first position wherein the hydraulic fluid is communicated directly with said one hydraulic cylinder, and a second position wherein the hydraulic fluid is communicated with a divider line;

a flow control valve positioned in said divider line downstream of said two-way valve, and including means for dividing the flow of hydraulic fluid therethrough into two equal streams; and means for communicating each of said two equal hydraulic streams from said flow control valve with a different one of said hydraulic cylinders, whereby when said two-way valve is in said second position, said forks are raised and lowered simultaneously at substantially the same rate and in the same direction.

9. A lift truck as set forth in claim 8, wherein:

said two-way valve includes a lever for manipulating the same, and said lever is disposed adjacent an operator control area of said lift truck.

10. A lift truck as set forth in claim 9, wherein:

each valve includes a lever for manipulating the same, and each lever is disposed adjacent said operator control area.

11. A lift truck as set forth in claim 8, including:

means for pivotally connecting said masts with said truck frame;

means for independently pivoting said masts; and means for pivoting said masts substantially simultaneously at the same rate and direction.

12. A lift truck as set forth in claim 11, wherein:

said mast pivoting means comprises third and fourth hydraulic cylinders.

13. A lift truck as set forth in claim 12, wherein:

said independent mast pivoting means includes a pressurized hydraulic fluid system, third and fourth valves operatively connected with said third and fourth cylinders respectively, whereby selective manipulation of said third and fourth valves extends and retracts said third and fourth cylinders to individually pivot said masts.

14. A lift truck as set forth in claim 13, wherein said simultaneous pivot means comprises:

a two-way pivot valve disposed in a hydraulic line communicating one of said hydraulic pivot cylinders with said second named pressurized hydraulic fluid system; said two-way pivot valve having a first position wherein the hydraulic fluid is communicated directly with said one hydraulic pivot cylinder, and a second position wherein the hydraulic fluid is communicated with a divider line;

a flow control pivot valve connected with said second named divider line, downstream of said two-way pivot valve, and includes means for dividing the flow of hydraulic fluid therethrough into two equal streams; and means for communicating each of the two equal hydraulic streams from said flow control pivot valve with a different one of said third and fourth cylinders, whereby when said two-way pivot valve is in said second position, said masts are tilted simultaneously at substantially the same rate and in the same direction.

15. In a lift truck having a frame with front and rear ends, and means for propelling said truck, the improvement of a dual mast arrangement for handling unbalanced loads and the like, comprising:

first and second lift masts pivotally connected with the front end of said truck frame in a side-by-side relationship; each lift mast having a movable fork connected therewith, and extending outwardly therefrom in a generally parallel relationship, means for translating said fork up and down its respective mast, and means for pivotally mounting said masts on said truck frame;

means for independently pivoting said masts; and coupling means selectively interlocking said masts and pivoting the same in unison, substantially simultaneously at the same rate and in the same direction, by manipulation of a single control, whereby said masts are pivoted rearwardly to lift the load balanced thereon to a transport position, and are tilted forwardly to set the load down in place.

16. A lift truck as set forth in claim 15, wherein:

said mast pivoting means comprises first and second double acting hydraulic cylinders.

17. A lift truck as set forth in claim 16, wherein:

said independent mast tilting means comprises a pressurized hydraulic fluid system having a valve block with a valve therein for each hydraulic cylinder, and means for communicating each valve with its associated cylinder, whereby selective manipulation of said valves extends and retracts said cylinders to individually pivot said lift masts.

18. A lift truck as set forth in claim 17, wherein said simultaneous tilt means comprises:

a two-way valve disposed in a hydraulic line communicating one of said hydraulic cylinders with said pressurized hydraulic fluid system; said two-way valve having a first position wherein the hydraulic fluid is communicated directly with said one hydraulic cylinder, and a second position wherein the hydraulic fluid is communicated with a divider line;

a flow control valve connected with said divider line, downstream of said two-way valve, and including means for dividing the flow of hydraulic fluid therethrough into two equal streams; and means for communicating each of said two equal hydraulic streams from said flow control valve with a different one of said hydraulic cylinders, whereby when said two-way valve is in said second position, said masts are pivoted simultaneously at substantially the same rate and in the same direction.

* * * * *